US005284466A

United States Patent [19]

Magnusson et al.

[11] Patent Number: 5,284,466

[45] Date of Patent: Feb. 8, 1994

[54] METHOD AND APPARATUS FOR FASTENING SHEETS OF PAPER TOGETHER WITH THE AID OF STAPLES

[75] Inventors: Bengt Magnusson, Ekero, Sweden; Roland Johnsen, Toms River, N.J.

[73] Assignee: Motterstitch Company, Lanoka Harbor, N.J.

[21] Appl. No.: 904,880

[22] Filed: Jun. 26, 1992

[30] Foreign Application Priority Data

Jun. 26, 1991 [SE] Sweden ..... 9101974

[51] Int. Cl.[5] ..... B27F 7/23; B65H 45/16; B41F 13/62; B41F 13/66

[52] U.S. Cl. ..... 493/385; 493/431; 493/432; 270/37; 227/81

[58] Field of Search ..... 493/384, 385, 427, 428, 493/429, 431, 432, 444; 270/37, 38; 227/81

[56] References Cited

U.S. PATENT DOCUMENTS

| | | | |
|---|---|---|---|
| 389,147 | 9/1888 | Heyl | 270/37 |
| 615,253 | 12/1898 | Crowell | 227/81 |
| 615,255 | 12/1898 | Crowell | 227/81 |
| 670,624 | 3/1901 | Seymour | 493/385 |
| 880,499 | 3/1908 | Bechman | 493/428 |
| 1,124,375 | 1/1915 | Wood | 493/385 |
| 2,082,262 | 6/1937 | Sather | 493/431 |
| 2,207,413 | 7/1940 | Quick et al. | 227/81 |
| 2,348,605 | 5/1944 | Carpenter | 493/431 |
| 2,797,085 | 6/1957 | Crafts | 493/431 |
| 4,545,782 | 10/1985 | Niemiro et al. | 493/431 |

FOREIGN PATENT DOCUMENTS

| | | | |
|---|---|---|---|
| 0034921 | 9/1981 | European Pat. Off. . | |
| 0038942 | 11/1981 | European Pat. Off. . | |
| 0128017 | 2/1902 | Fed. Rep. of Germany . | |
| 2837392 | 2/1980 | Fed. Rep. of Germany | 493/427 |
| 0622984 | 6/1927 | France . | |
| 160769 | 10/1957 | Sweden . | |
| 162258 | 2/1958 | Sweden . | |
| 411197 | 12/1979 | Sweden . | |
| 443116 | 2/1986 | Sweden . | |
| 0115954 | of 1900 | United Kingdom . | |
| 0304264 | 1/1929 | United Kingdom . | |

*Primary Examiner*—William E. Terrell
*Attorney, Agent, or Firm*—Quarles & Brady

[57] ABSTRACT

Apparatus for fastening and folding stacks of paper sheets includes a stitching unit adapted to collect staples and insert them in the sheet stack while a folding knife simultaneously drives a section of the sheet stack into a gap of the stitching unit to fold the stack. The inserting edge of the folding knife provides the die for bending the inserted staple into a secured configuration. The folding knife and the stitching unit gap are preferably mounted on planet wheels of coordinated planetary gears so that the knife and the gap periodically align to fold and fasten the sheet stacks.

11 Claims, 5 Drawing Sheets

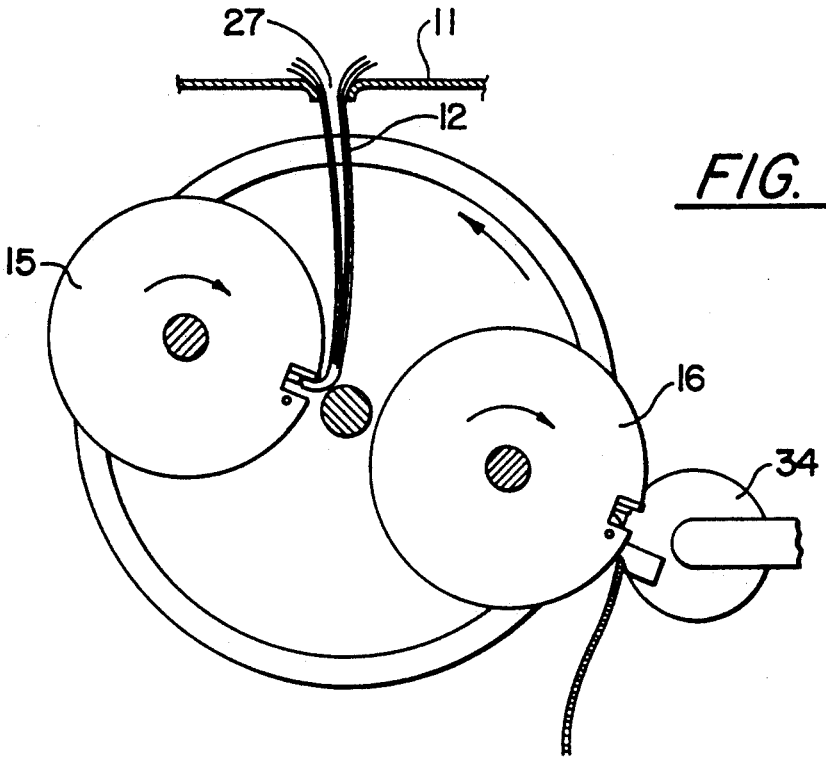
FIG. 4
FIG. 5
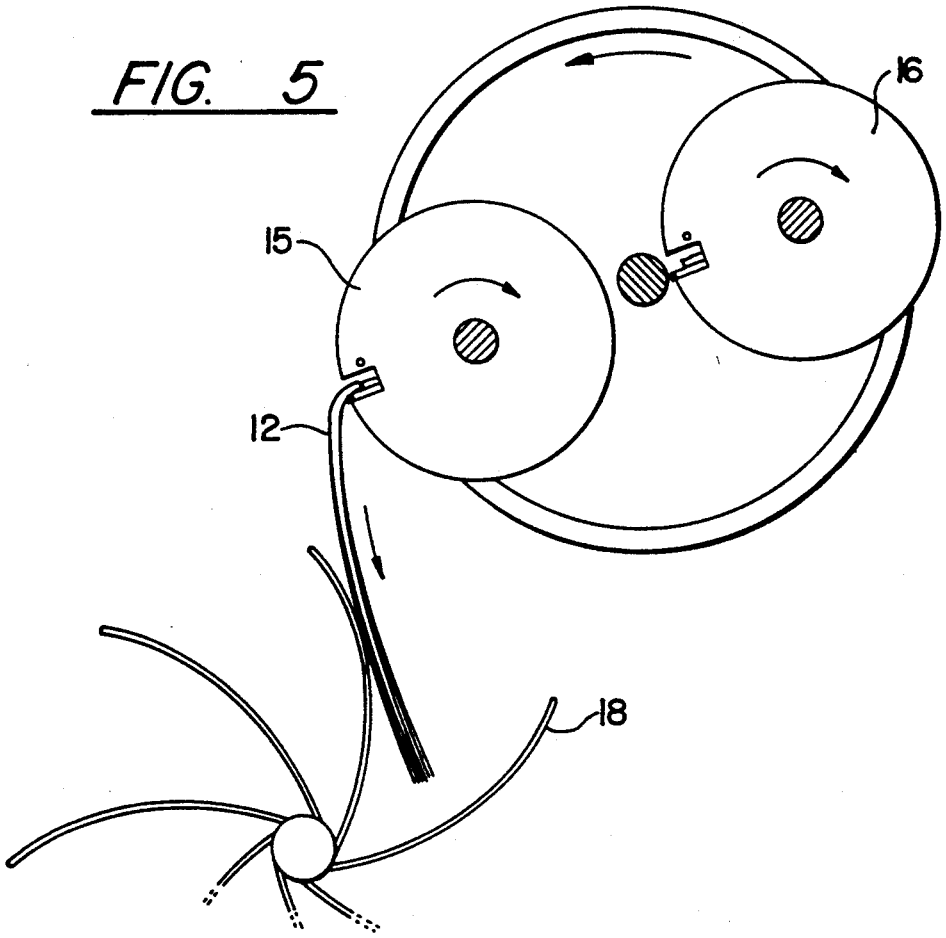

METHOD AND APPARATUS FOR FASTENING SHEETS OF PAPER TOGETHER WITH THE AID OF STAPLES

The present invention relates to a method and apparatus for fastening together with staples a plurality of sheets of paper placed one on top of the other to form a sheet signature according to the preambles of the respective claims 1 and 11.

Several methods and apparatus of this kind are already known. There are different types of stitching machines for stitching together products printed in rotary presses, and these maybe divided into three groups: in-line, on-line and off-line, depending on their placing in relation to the rotary press. The folded format of the printed product is also decisive for the location of the stitching machines.

With in-line stitching the stitching machine is placed in the folding apparatus of the printing press, and operates for stitching sheet signatures (newspapers, magazines etc.) at the rate they are produced in the press.

On-line printing takes place together with further work on the printed product in a separate production line, which can be connected to, or put on line with the press. However, the stitching machine is not situated in the press.

In off-line stitching, the sheet signatures are first printed and folded in the press, after which they are stacked for intermediate storage, and are subsequently taken to a separate binder line for stitching and final processing.

For providing printed products in different formats, the following apparatus in the rotary press is utilized according to the following: The rotary presses commercially used today work either with double width, the paper web width being about 1600 mm or single width, the web width then being about 800 mm. In the large press the paper web is cut up into two strips after printing but before folding. These strips are then laid one upon the other and both large and small presses then function in a similar fashion with respect to folding.

To provide a printed product of broadsheet format the paper web is taken over a conicly shaped plate, for folding the web at its center along the direction of travel. This first fold is called the broadsheet fold.

To produce a product in half format, a folding mechanism situated under the conicly shaped plate is used, where the web is cut into sheet signatures and folded once again, this time transversally. This is called "the second fold", and results in a haf format or tabloid fold. The printed products are then usually conveyed out of the folding apparatus via a star wheel distributor and a dispatch table for further conveyance and distribution of the products.

In a so called magazine printing press the product is folded once more, this time along its length, this being a second longitudinal fold or quarter fold. The final result will be a magazine-type product in approximately A4-format.

In letterpresses the product may be folded once more transversally after the tabloid fold. The result here will be a second transverse fold or parallel fold (double parallel fold). This folding procedure is used in book production, above all in the production of the more simple kind of book products, e.g. pocket.

Glueing is used today for keeping together printed products (newspapers) in broadsheet format, where the sheets in the products are at all connected to each other. A rotary stitching apparatus installed in the rotary press is preferably used for fastening together printed products in tabloid format. The stitching apparatus is usually placed in the folder above the folding mechanism, directly under the conicly shaped plate, but there may also be other locations. Today's stitching machines can cope with stapling 8–128 pages at a rate of up to 80.000 newspapers per hour. The stitching machine is usually provided with two stitching heads. This machine is compartively cheap and so rapid that it does not constitute any production-limiting factor in rotary presses.

Today, stitching machines arranged in a separate line is all that is available for stapling printed products in quarter fold format. Accordingly quarter fold stitching machines are connected to special magazine presses, the apparatus in this case having the same functional principal as the above-mentined half format stitching machine, but is turned 90° in relation to the production direction. In a so-called saddle stitching machine the different sides of the product are placed after trimming into a feeding apparatus which places the sheet on a conveyor. The spine of the product is then stapled against this conveyor. A further solution to stapling quarter-folded products is an apparatus which staples them in connection with they being placed on feed drums for inserting such as advertisement products in newspapers. The feed drum, which operates on-line with the press, has a diameter of 2–3 m and length of about 4–5 m. Quarter fold stitching apparatus is built into this drum for each of the drum compartments, which can amount to about 50.

The known apparatus for stapling quarter fold printed products has certain problems, amongst others that they constitute limiting factors for the production rate of the printing press, or take up comparatively large space. Common for them is that they are very expensive.

Accordingly, one object of the present invention is to provide an apparatus and a method which permit stapling and folding, particularly quarter folding of printed products in-line, and which solves the above mentioned problems as well as having a comparatively low price. The aim of the invention is achieved with a method and apparatus in acordance therewith, and which are characterized by the features disclosed in the characterizing portions of claims 1 and 11.

Thus, in accordance with the invention, by pressing the sheet signatures downwardly through a gap or the like with the aid of a folding knife, where a counterdie for making a staple fastening with the aid of staple blanks is arranged on the edge of the knife facing towards the sheet signature, there is enabled folding the printed product while it is stapled substantially simultaneously. This solution carries with it a plurality of advantages, namely:

- stapling takes place in-line in the same operation as folding,
- the folding-cum-stitching machines can be built into the folding apparatus of the press and thus does not take up any extra floor space,
- the stitching machine does not constitute any speed-limiting factor for the press,
- the stitching machine can be provided at a relatively low price which is comparable with the price for tabloid stitching machines.

Since the apparatus can be built into an ordinary newspaper press as well as in a magazine press, the possibility for the ordinary printer to provide stapled quarter fold printed products is improved. In addition, as disclosed in claims 2, 3, 5 and 6, by having the folding knife/knives and/or the stapling unit/units driven by a planetary gear system, there is achieved with a selection of gear ratio a very suitable motion, particulary in the stitching, collection and discharge positions.

By having, as is disclosed in claims 8, 9 and 13, the blanks being carried by partially resilient seatings and being temporarily retained by retaining elements there is achieved reliable guiding of the blanks during the stapling process, as well as reliabe conveyance of the blanks from the collection position to the stapling position.

By having, as is disclosed in claim 10, the stapling unit also provided with grippers for the stapled and folded sheet signature there is further accentuated the compact and user-friendly propertis of the apparatus.

Further advantages are achieved by the distinguishing features defined in the remaining dependent claims.

The invention will now be described in more detail and with guidance from an embodiment which is illustrated in the associated figures, where:

FIG. 1 illustrates, in a partially section side view, a combined folding and stitching machine apparatus in acordance with the present invetion, FIG. 2*a* is a perspective view of a folding knife cylinder with associated planet wheels, FIG. 2*b* illustrates a detail of the outer edge of the folding knife with a die profile recess, FIG. 3 is a cross section through the apparatus according to FIG. 1 in a first position, FIG. 4 is a cross section through the stitching mechanism according to FIG. 1 i a second position, FIG. 5 illustrates the stitching mechanism in a third position, FIG. 6 is a perspective view of a stitching cylinder with associated planet wheel, FIG. 7 illustrates in detail the gripping mechanism at the stitching cylinder according to FIG. 6, FIGS. 8–11 illustrate in detail the seatings for the staple blanks at the stitching cylinder according to FIG. 6, FIG. 12 illustrates coaction between the folding knife and the stitching cylinder at the stitching instant.

FIGS. 13 and 14 respectively illustrate an unfolded and a folded and stapled printing product produced with the aid of an apparatus in accordance with the invention.

FIG. 1 illustrates a combined folding and stitching machine 1 including a stand 4, which, on its upper part carries a folding mechanism with two folding knife cylinders 3, 4, which are connected to their respective planet wheels 6. These wheels are included in a first planetary gear 5, which otherwise includes a gear ring 8 to mesh in with the wheels 6, there also being a gear wheel 7 for driving the planet wheels, the wheel 7 being in turn driven by a transmission 9 synchronicly with the press There is a transverse folding table 11 under the folding mechanism, the sheet signatures 12 being fed on to this table axially in relation to the folding knife cylinders 2, 3 for being stapled and folded. The sheet signatures 12 are fed in the direction of the arrow 13 from a printing press over the transverse folding table via a feed means 14 consisting of conveyor belts. A stitching mechanism is arranged under the transverse folding table 11, and this mechanism includes two stitching cylinders 15, 16, which are driven by a second unillustrated planetary gear arranged in a housing 17 in a similar manner to the first planetary gear 5. The folded and stapled printed products are fed out from the apparatus via a star wheel distributor 18, and a discharge table 19 in a manner known per se.

In FIG. 2*a* there is illustrated the folding knife cylinder 4 with associated planet wheels 6, there also being indicated by chain-dotted lines a sheet signature 12 in a position for stapling and folding. On its lower portion in the figure the cylinder 4 has a folding knife 12, the outer edge of which is denoted by 21.

FIG. 2*b* shows in detail the outer edge 21 of the knife 20 in the area of an expanded portion 22, on which a die profile 23 is ingraved or otherwise recessed. The die profile 23 forms the bearing surface for staple blanks which are to be formed into stapled fastenings.

FIG. 3 illustrates a cross section through the apparatus in accordance with FIG. 1. Driving the folding knife cylinders 3, 4 takes place such that the wheel 7 is driven in the direction of the arrow 26, these cylinders then rotating in the respective directions of the arrows 24 and 25. The outer edge 21 of the knife 20 will thus describe a substantially triangularly shaped path T1 with one of the triangel's corners directed downwardly. In the position illustrated in FIG. 3, the outer edge 21 is in this position. The transverse folding table 11 has a gap 27 with softly rounded edges 28 in its central portion. When the sheet signatures 12 are folded, the folding knife 20 coacts with the gap 27 to provide a folding crease.

The stitching cylinder 15 uppermost in the figure has an axial groove 29 immediately under the gap 27 which is the stitching position in the figure. These cylinders 15 and 16 are driven in a corresponding way as the folding cylinders 3 and 4 by a planetary gear where the driving member rotates in the direction of the arrow 32, causing the cylinders to rotate in the respective directions of the arrows 30 and 31. The axial grooves 29 of the cylinders will thus describe a substantially triangularly shaped path T2 where the corners of the triangle, apart from the mentioned stitching position also are the collection position 33 for staple blanks and the discharge position 39. In the collection position 33 the cylinders coact with a unit 34 forming the staple blanks, the unit being supplied with staple wire 37 from a wire roll 38 via a feed mechanism 36 and a guide hose 35. In the discharge position 39 the folded and stapled product is released into a compartment in the star wheel distributor 18 for further conveyance in a manner known per se.

In the position illustrated in FIG. 4, the stitching cylinder 16 has been rotated to the collection position where it collects the staple blanks under coaction with the forming unit 34. The cylinder 15 has simultaneously been rotated downwards from the stitching position and has nearly completely pulled the printed product 12 through the gap 27 of the transverse folding table 11.

In the position illustrated in FIG. 5, the stitching cylinder 15 is in the discharge position and with its grippers has just released the printed product 12, which falls down into a compartment of the star wheel distributor 18. The cylinder 16 is simultaneously moving from the collection position to the stitching position.

FIG. 6 illustrates the stitching cylinder 15 with associated planet wheel 40. On its upper part in the figure, the cylinder is provided with an axial groove 29, which contains grippers for gripping a printed product as well as seats and retainers for staple blanks. Both gripping means and retainer means for the staple blanks are controlled by a cam shaft 42 indicated in the figure by dashed lines, the cam shaft being activated by a cam 43 (see FIG. 7) via a cam follower 41 and roller. In addition, the cylinder 15 has two circumferencial grooves 47 directly opposite the seats for the staple blanks.

FIG. 7 illustrates in detail the cam mechanism for controlling the grippers 75 and retainers 52 of the stitching cylinder 15. A cam 43 fixed to the stand is followed by a cam follower 41 and its roller, the follower being controlled by the cam 43 against the action of a tension spring 44. The movement of the cam follower 41 is transferred via the cam shaft 42 to the grippers 45 of the cylinder, which coact with dies 46 fixed in the cylinder. The gripping position of the grippers 45 is indicated by chain-dotted lines in the figure. The retainer 52 for the stapled blanks is controlled synchronicly with the grippers 45. The releasing and retaining position for the retaining fingers 52 constituting the retainers is denoted by dashed lines and chain-dotted lines, respectively, in the figure.

FIG. 8 ilustrates in detail one of the stitching cylinder seats for the staple blanks. The seat comprises a staple support 48 made resilient by a compression spring 50 and acting as support for the legs of the staple blanks, there also being a fixed bottom support 49 arranged in this cylinder as support for the web portion of the staple blanks. Both support elements 48 and 49 are provided with recesses 51 for a staple blank. This blank is retained in the recess of the seat with the aid of the retainer finger 52 illustrated by chain-dotted lines.

As will be seen from FIG. 9, the resilient staple support 48 has a bearing shoulder 53 on each of the parts guiding the staple blanks and radially upstanding on either side of the fixed bottom support 49. The shoulders 53 serve as temporary retension of a staple blank 54 immediately prior to its being given a U-shape. In this position the retainer finger 52 has uncovered the seat.

FIG. 10 illustrates how a pressure wheel 54 indicated by chain-dotted lines and associated with the forming unit 34 has given the staple blank 54 a U-shape in coaction with the seat, by pressing the blank down into the previously mentioned recesses 51. It will also be seen from FIG. 10 how the pressure wheel 55 moves in the circumferencial groove 47.

In FIG. 11 it is shown how the retainer finger 52 retains the staple blank 54 during the rotation of the stitching cylinder between the collection position and the stiching position. It will also be seen that the gripper 45 and associated bolster 46 has in this phase its upper edges at a level below the upper part of the seat but above the bottom part of the seat defined by the upper surface of the fixed bottom support 49.

FIG. 12 illustrates the coaction of the folding knife 20 with the stitching cylinder at the stitching instant. The knife 20 with its accompanying downwardly pressed sheet signature 12 is urged in this position against the resilient staple support 48 into a level substantially at the same hight as the uper surface of the fixed bottom support 49. In connection with this depression of the staple support 48 the staple blank 54 will be successively uncovered to penetrate through the sheet signature 12. After being pressed through, the upper ends of the blank 54 will reach the die profiles made in the outer edge of the knife 20 and will be thus formed into a complete staple fastening, as is indicated by dashed lines in the figure. Immediately before compression, the retainer finger 52 has of course been taken out of coaction with the staple blank. Simultaneously with the depression of the sheet signature to this position, the grippers of the stitching cylinder are activated to grip the printed product 12 against their counter surfaces. After this, the stitching cylinder leaves the stitching position, pulls the product 12 down through the gap 27 and takes it further to the discharge position 39 where it releases it into the star wheel distributor 18.

Figure 1:
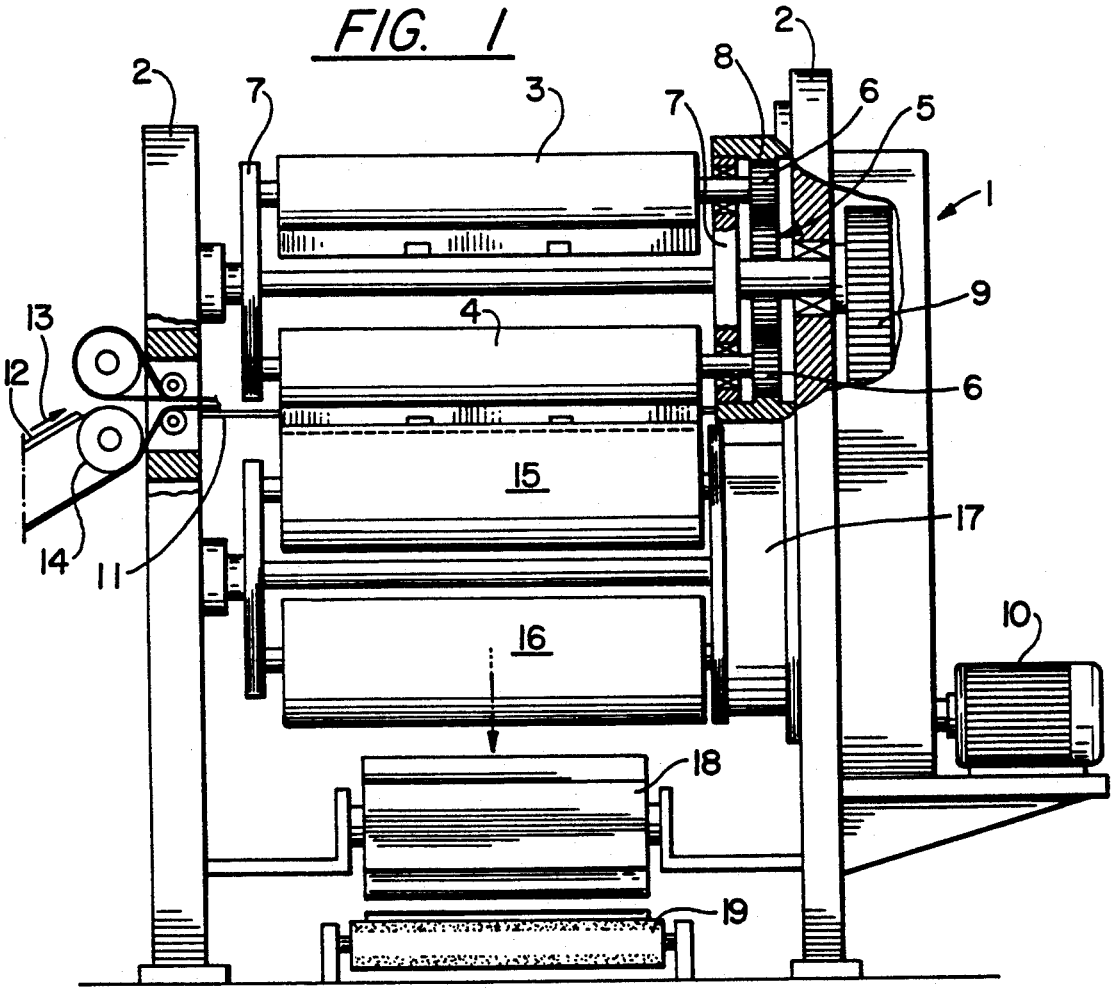
Figure 2B:
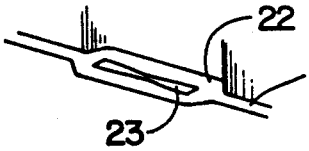
Figure 2A:
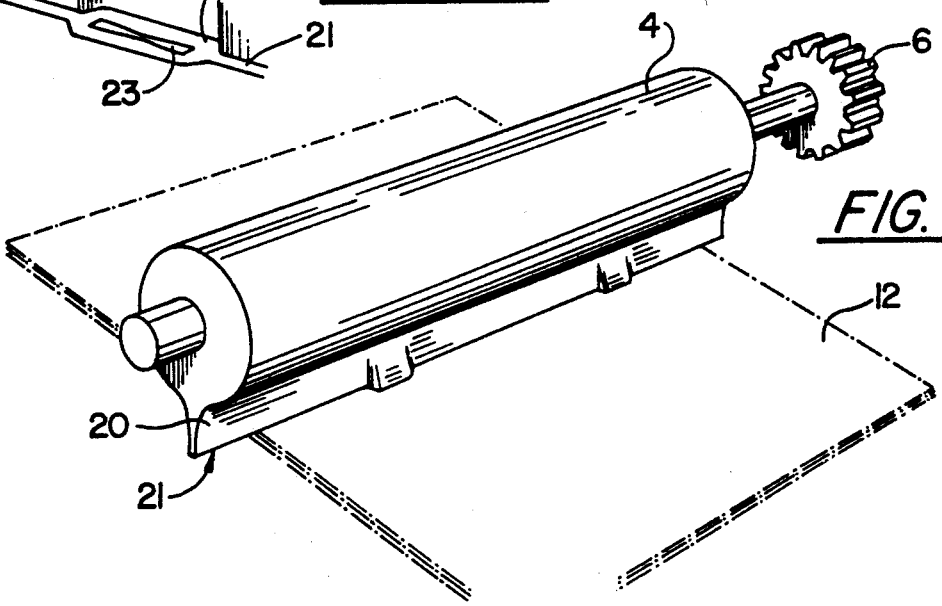
Figure 3:
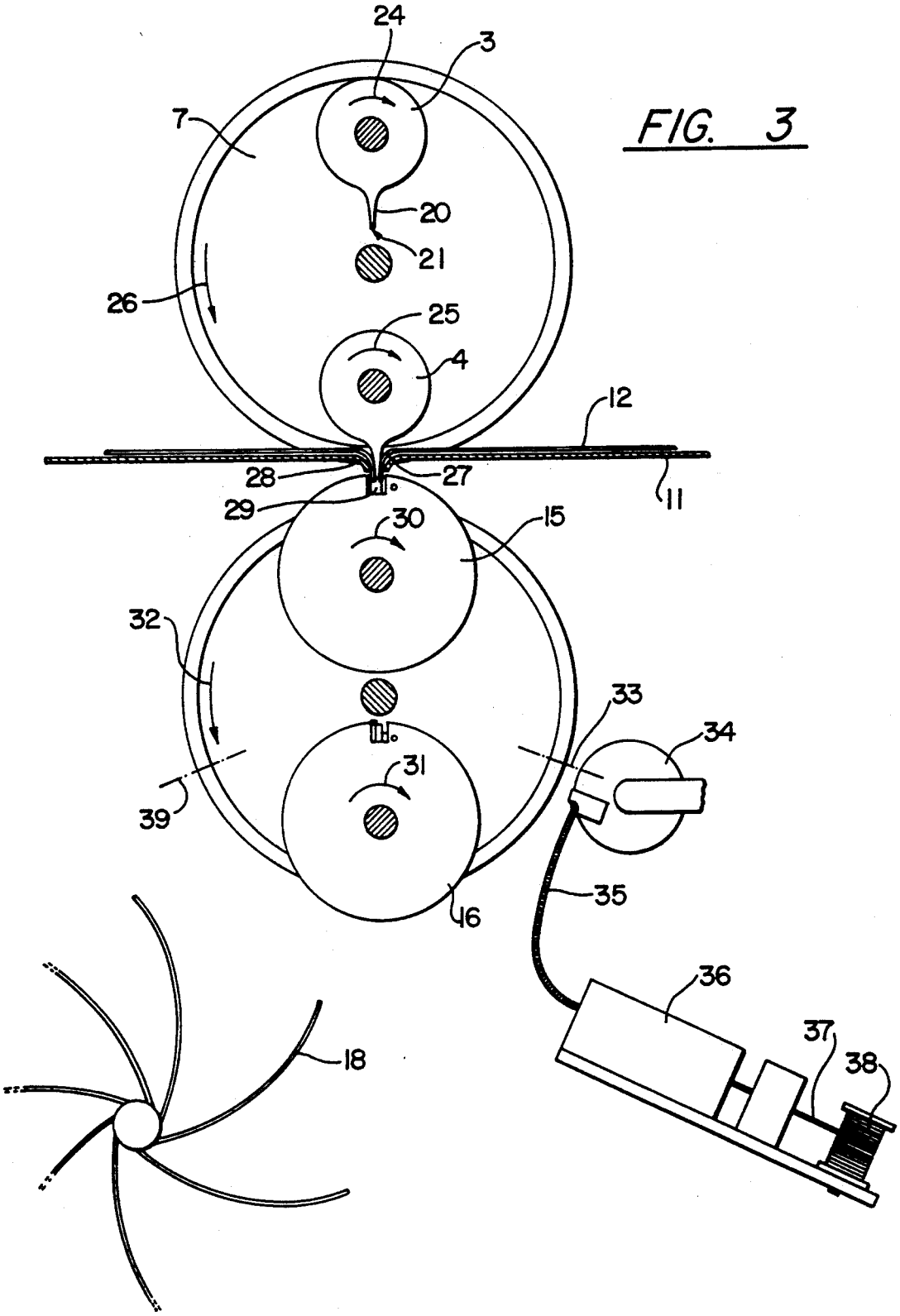
Figure 6:
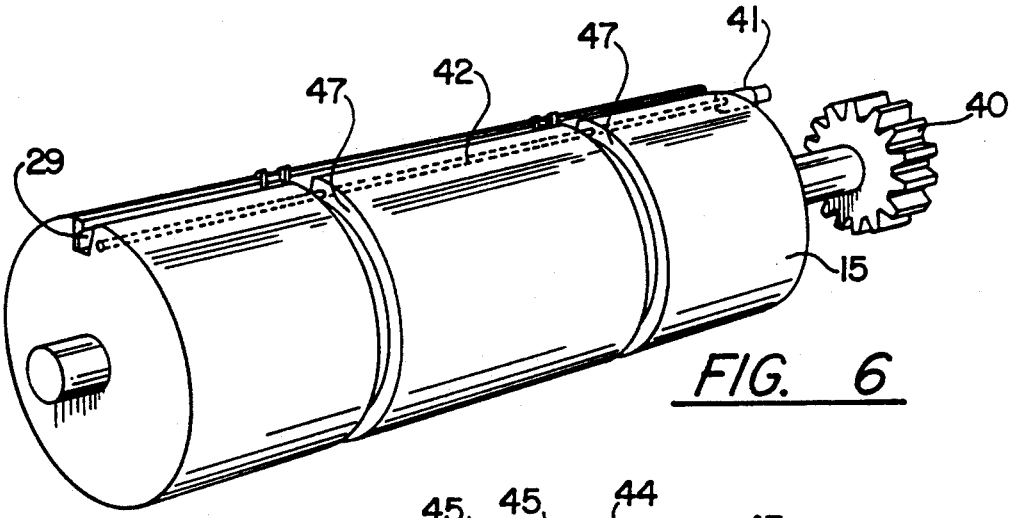
Figure 7:
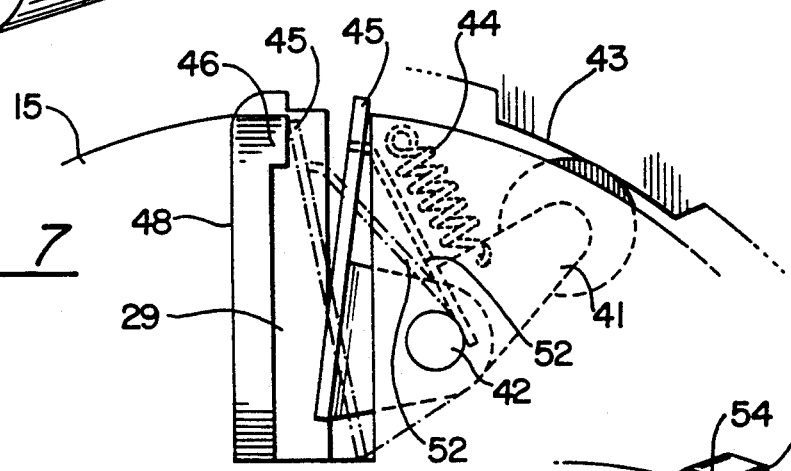
Figure 8:
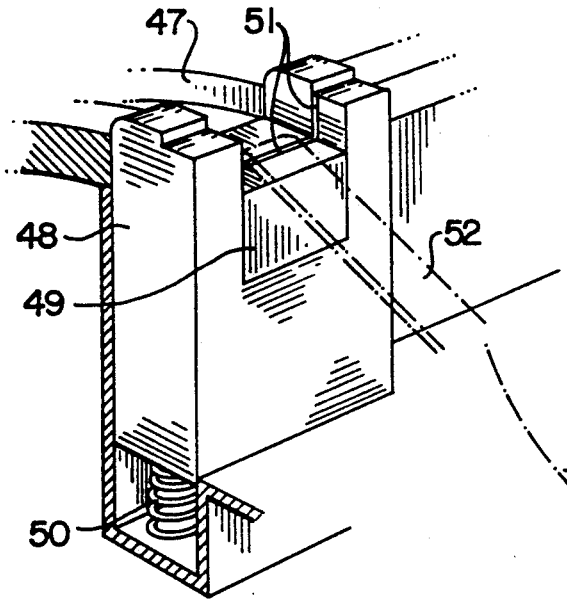
Figure 9:
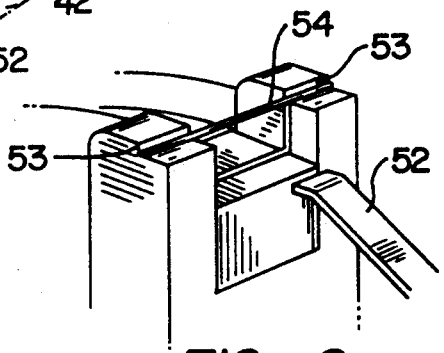
Figure 10:
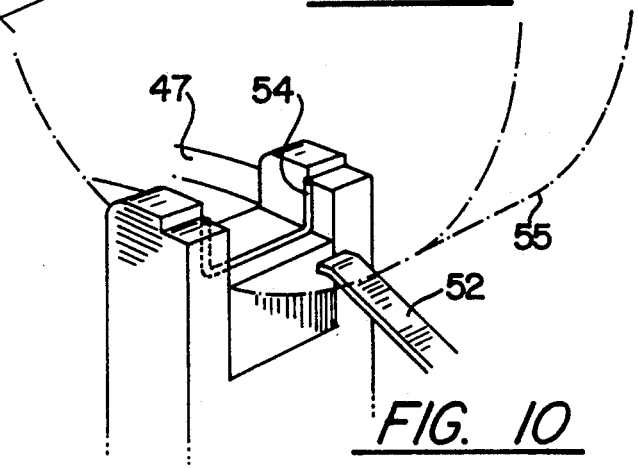
Figure 11:
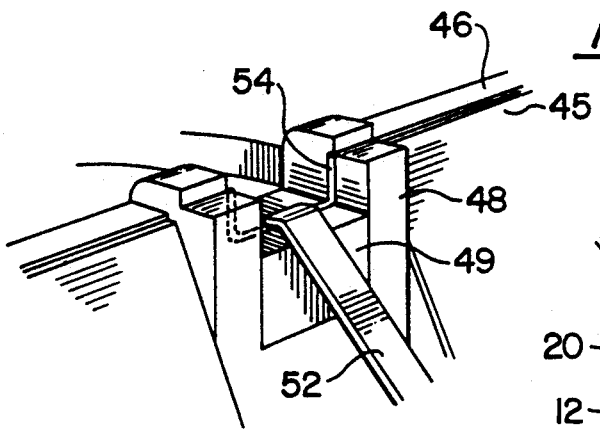
Figure 12:
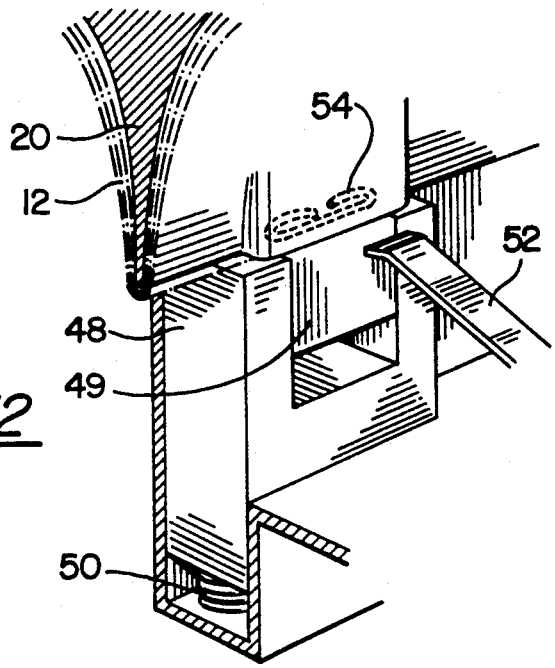
Figure 13:
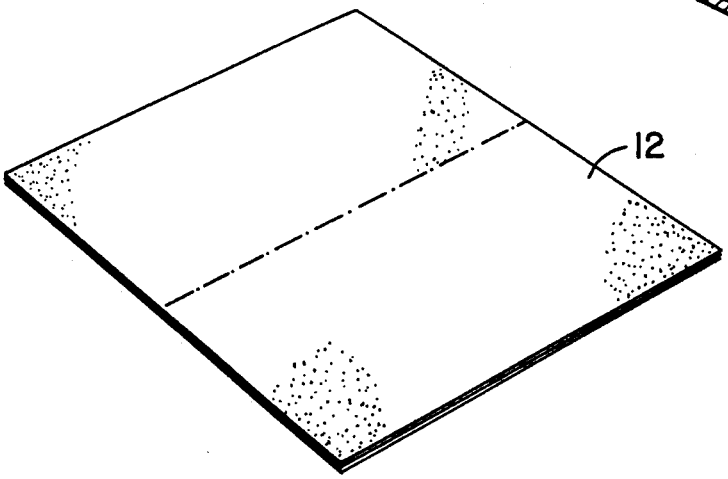
FIG. 13 illustrates a sheet signature 12 intended for folding and stitching, and indicates a coming folding line with the aid of a chain-dotted line.
Figure 14:
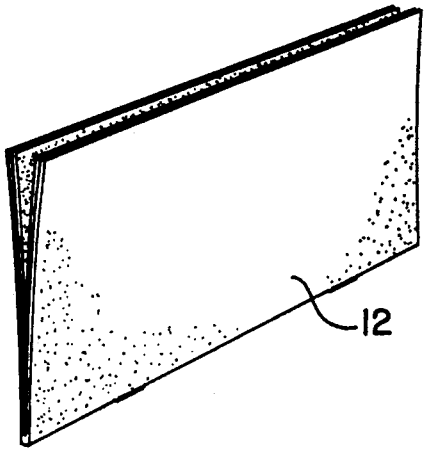
FIG. 14 illustrates the same printed product in a folded and stitched condition.

The embodiment described in connection with the figures is only to be regarded as an example of the invention. The invention is only limited by what is apparent from the following claims.

The invention can thus be modified in many ways, e.g. neither the folding knife nor the stitching mechanism need to be controlled by planetary gears, although this embodiment has been found to be particulary suitable. The folding knife provided with die profiles can be controlled, for example, by a upward-downward movement provided by any known mechanism.

In the described embodiment example, the stitching unit is a unit together with grippers for the folded and stapled printed products, but these parts can very well be arranged in two separate units, which are given movement in some other way than by a planetary gear. In the figures the expansion 22 in the area of the die profiles on the folding knives has been exagerated somewhat for the sake of clarity. Within the scope of the invention, the outer edge of the folding knife can be uniformly thick along its length or provided with an insignificant expansion in the areas of the die profiles. As an alternative to fixed die profiles in the outer edge of the folding knife, the latter may be provided with loose, exchangeable profiles suited to different staple sizes.

Within the scope of the invention, the stapling mechanism can also be formed in som other way than has been described above. It is conceivable to use ready-shaped staple blanks and to use a stitching unit substantially corresponding to the office stapler type. The stitching and folding mechanism can also be formed with one or more cylinder units.

Instead of being spring loaded, the staple support can be controlled by such as a cam. The grippers and retainer fingers may also be controlled in some other way, e.g. using double, compulsory movement cams.

Pulling down the folded and stapled product can also take place in some other way, e.g. by pull-through rolls situated on either side of the gap 27.

We claim:

1. Apparatus for fastening a sheet signature comprising a plurality of sheets of paper laid one on top of the other with staples, said apparatus comprising:

a stitching unit for carrying staple blanks and inserting the staple blanks into the sheet signature, said stitching unit having seats for receiving the staple blanks in a collecting position and positioning each of the staple blanks for insertion into the sheet signature, said seats being disposed in a groove of an outer face of the stitching unit, said seats and said groove being movable repetitively to and from a stitching position at which a staple blank is inserted through he sheet signature;

a folding knife for folding the sheet signature, said folding knife having an edge which is repetitively movable to and from the stitching position and is coordinated to arrive at the stitching position at the same time as the seats and groove, said edge folding the sheet signature and pushing the sheet signature toward the groove for insertion of the staple blank;

a die positioned on the edge of the folding knife for bending the inserted staple blank to secure the staple blank to the sheet signature when said edge is inserted into said groove, whereby the sheet signature is substantially simultaneously fastened and folded;

grippers disposed in the groove of the stitching unit for gripping the fastened and folded sheet signature and carrying it to a discharge position away from the stitching position as the stitching unit groove moves away from the stitching position; and a planetary gear and planet wheel assembly for supporting and moving the stitching unit to and from the stitching position, said stitching unit being rigidly connected to the planet wheel.

2. The apparatus of claim 1, further comprising a second planetary gear and planet wheel assembly for supporting and moving the folding knife to and from the stitching position, said folding knife being rigidly connected to the second planet wheel.

3. The apparatus of claim 2, further comprising at least one further planet wheel disposed on said second planetary gear and at least one further folding knife rigidly mounted on said at least one further planet wheel, said planet wheels being uniformly distributed on said planetary gear.

4. The apparatus of claim 1, further comprising a table along which the sheet signature travels for folding through pushing in a slot in the table aligning with the groove at the stitching position.

5. The apparatus of claim 1, further comprising at least one further planet wheel disposed on said planetary gear and at least one further stitching unit rigidly connected to said at least one further planet wheel, said planet wheels being uniformly distributed on said planetary gear.

6. The apparatus of claim 1, further comprising retaining means for retaining the staple blanks between a collection position and the stitching position, said seats including a fixed bottom part for supporting a transverse web portion of each staple blank and resilient staple support portions for supporting legs of each staple blank.

7. The apparatus of claim 6, further comprising means for retracting said resilient staple support portions to uncover each staple blank to be inserted in the sheet signature during alignment of the stitching unit and the folding knife at the stitching position.

8. A method for fastening a sheet signature comprising a plurality of sheets of paper laid one on top of the other with staples, said method comprising the steps of:

providing a stitching unit on a rotating planet wheel of a planetary gear assembly, said stitching unit having means for inserting a staple blank into the sheet signature, said inserting means being disposed in a groove of the stitching unit;

rotating the planet wheel so that the stitching unit groove moves to a stitching position at which the sheet signature overlays the opening of the groove;

moving a folding knife to the stitching position so as to fold the sheet signature and align with and push the folded sheet signature toward the groove at the stitching position, thereby inserting a portion of the sheet signature into the groove with an inserting edge of the folding knife groove;

simultaneously inserting the staple blank through the sheet signature to a die on the inserting edge of the folding knife while a folding spine is created in the sheet signature as the sheet signature is pushed to the groove;

bending the staple blank against the die to secure the blank to the sheet signature;

gripping the sheet signature within the groove; and carrying the sheet signature to a discharge position away from the stitching position.

9. The method of claim 8, wherein the staple blank is retained in the stitching unit during its movement to the stitching position, where the retention ceases.

10. The method of claim 8, wherein the staple blank is retained in support parts which are:

outwardly spring loaded and have recesses, and support parts being moved, so as to expose the staple blank for insertion, by the die.

11. The method of claim 8, wherein the sheet signature is urged downward to the groove through a slot in a table.

* * * * *